US008833922B2

(12) United States Patent
Edwards

(10) Patent No.: US 8,833,922 B2
(45) Date of Patent: Sep. 16, 2014

(54) PRINTING SYSTEM FOR APPLICATION OF A PATTERNED CLEAR LAYER FOR REDUCING GLOSS BANDING

(75) Inventor: Paul A. Edwards, Saline, MI (US)

(73) Assignee: Electronics for Imaging, Inc., Fremont, CA (US)

( * ) Notice: Subject to any disclaimer, the term of this patent is extended or adjusted under 35 U.S.C. 154(b) by 81 days.

(21) Appl. No.: 13/302,872

(22) Filed: Nov. 22, 2011

(65) Prior Publication Data

US 2013/0127960 A1 May 23, 2013

(51) Int. Cl.

*B41J 2/01* (2006.01)
*B41J 2/21* (2006.01)
*B41J 11/00* (2006.01)

(52) U.S. Cl.

CPC ..... *B41J 2/2114* (2013.01); *B41J 11/002* (2013.01)
USPC ..... 347/102; 347/9

(58) Field of Classification Search

CPC ..... B41J 11/002; B41J 11/0015; B41J 2/01; B41M 7/0072; C09D 11/101
USPC ..... 347/102, 9
See application file for complete search history.

(56) References Cited

U.S. PATENT DOCUMENTS

| | | | | |
|---|---|---|---|---|
| 6,064,397 | A | 5/2000 | Herregods et al. | |
| 6,690,484 | B1 * | 2/2004 | Borrell et al. | 358/1.9 |
| 2005/0206678 | A1 | 9/2005 | Nishino | |
| 2007/0058020 | A1 * | 3/2007 | Wetjens et al. | 347/102 |
| 2010/0014120 | A1 | 1/2010 | Nishiyama et al. | |
| 2010/0227075 | A1 | 9/2010 | Belelie et al. | |
| 2011/0085013 | A1 * | 4/2011 | Onishi et al. | 347/102 |
| 2011/0235069 | A1 | 9/2011 | Otsuka et al. | |

* cited by examiner

*Primary Examiner* — Manish S Shah
*Assistant Examiner* — Yaovi Ameh
(74) *Attorney, Agent, or Firm* — Michael A. Glenn; Perkins Coie LLP

(57) ABSTRACT

The invention involves application of a clear, low-density after-layer of high gloss ink onto a printed substrate to reduce or eliminate negative printing effects, such as gloss banding. Some embodiments of the invention involve a method of applying colored ink, curing the colored ink, applying a clear ink layer in a pattern, and curing the clear layer.

22 Claims, 7 Drawing Sheets

PRINTING SYSTEM FOR APPLICATION OF A PATTERNED CLEAR LAYER FOR REDUCING GLOSS BANDING

BACKGROUND OF THE INVENTION

1. Technical Field

The invention relates to ultraviolet inkjet printing. More specifically, the invention relates to the application of a visually clear, low print density after-layer of high gloss ink.

2. Description of the Prior Art

Inkjet printing involves depositing droplets of liquid ink onto a printing medium from one or more printer heads. The printer heads are coupled with a container containing ink. Ink is ejected from one or more nozzles of the print heads when a piezoelectric crystal in the print head is actuated. The piezoelectric crystal generates a pulse in the ink so that the ink expels through the nozzle as a droplet. To create the image, a carriage which holds one or more print heads scans or traverses across the printing medium, while the print heads deposit ink as the printing medium moves.

Large format printing is performed to create signs, banners, museum displays, sails, bus boards, POP applications and the like. Oftentimes consumers of large format prints prefer to choose a full or partial gloss finish to create striking displays. Gloss finishes come in various reflective intensities measured in Gloss Number. Gloss Number measures how much light is reflected at a given position. In today's art, gloss finishes are commonplace with solvent based SWF printers, but a high gloss finish is not available on today's UV printers due to the fact that the curing of the droplets of UV ink leaves a matte surface structure, rather than a very smooth finish. The relatively matte looking prints can and do suffer from a print artifact (gloss banding) which is often undesirable for many customer applications.

Gloss banding is defined as a variation in gloss between subsequent print bands on wide and super-wide format printers. This gloss variation is very visible to the eye and has a directionality component, i.e. the effect changes with viewing angle. The gloss variation is visibly most prominent when the overall gloss of the print is neither very high or very low, i.e. above gloss number value of 10 and below around 60. There have been a variety of methods employed to improve or solve gloss banding.

For example, some approaches involve use of large ink droplets to achieve a matte effect, this can also have a negative impact of print quality due to the low DPI and also in reducing color gamut, due to the less efficient use of pigment. Also formulating inks to have low drop spread and hence increased matte have been tried. This method also suffers from poor color gamut.

Another approach is to provide gloss control on an image via a curing process, in which a curable ink formulation has a variable cure by virtue of a patterned mask placed between the light source and the uncured print. The partially cured image is then fully cured via a flood lamp. The variable gloss is created due to the formation of a rough surface, caused by the variable initial cure.

According to this approach, the image usually comes out as high gloss from the printing process and the micro-patterning reduces the gloss to become more matte. Therefore, the degree of gloss is controlled by the number and size of the holes in the mask. Critical to this approach is the use of a gelling agent. The gelling agent ensures the ink is solid at temperatures below about 60° C. to reduce the absorption into paper or other absorptive substrates. Therefore, either the exposed areas become liquid during the UV mask curing or the non-exposed become liquid before they become solid in the final cure, thereby providing the pattern.

What is needed is a system of provide gloss control for images which does not use a gelling agent, or use variations in cure to obtain the level of gloss variation. Accordingly, the invention solves the problem of the "gloss banding" defect at the highest print speeds, whilst maintaining a large color gamut.

SUMMARY OF THE INVENTION

The invention involves application of a clear, low print-density after-layer of high gloss ink onto a printed substrate to reduce or eliminate negative printing effects, such as gloss banding.

Some embodiments of the invention involve a modified printer carriage configured with a plurality of groups of print heads configured for applying colored ink and clear ink after-layers. Some embodiments of the invention involve one or more curing lamps associated with the modified carriage for curing the layers of ink as they are applied.

Some embodiments of the invention involve a printer system configured with a rail system and a carriage that traverses back-and-forth along the rail as a substrate is moved beneath the rail. Other embodiments involve an in-line printing system.

Some embodiments of the invention involve a method of applying colored ink, curing the colored ink, applying a clear ink layer in a pattern, and curing the clear layer. Some embodiments of the invention involve applying the clear ink layer in preprogrammed pattern. Other embodiments of the invention involve gathering clear ink layer pattern information from the source file itself and applying the clear ink layer as specified. Other embodiments of the invention involve accepting user specifications for the application of the clear ink layer and applying the clear ink layer as specified by the user.

DETAILED DESCRIPTION OF THE INVENTION

The invention is designed to essentially resolve the problem of gloss banding, without negatively impacting other critical features, such as color gamut. The invention also allows the customer to control the level of gloss such that the print artifacts are minimized.

Figure 1:
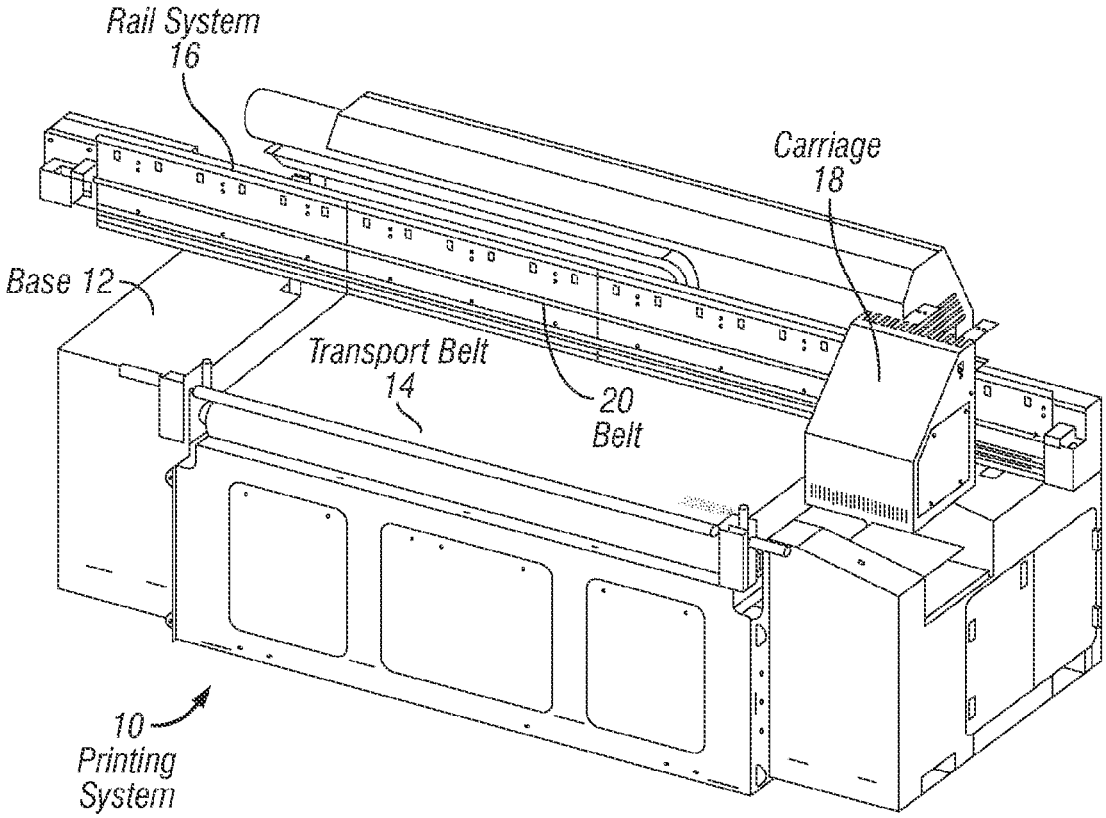
FIG. 1 (Prior Art)
FIG. 1 illustrates an isometric view of a common printing system adapted for printing images on a variety of substrates.

FIG. 1 is an isometric view of a prior art printing system 10, adapted for printing images on a variety of substrates. The printing system 10 includes a base 12, a transport belt 14 which moves the substrate through the printing system, a rail system 16 attached to the base 12, and a carriage 18 coupled to the rail system 16. The carriage 18 holds a series of inkjet print heads (not shown) and is attached to a belt 20 which wraps around a pair of pulleys (not shown) positioned on either end of the rail system 16. A carriage motor is coupled to one of the pulleys and rotates the pulley during the printing process. As such, when the carriage motor causes the pulley to rotate, the carriage moves linearly back and forth along the rail system 16.

According to FIG. 1, as the substrate moves through the system 10, the inkjet print heads deposit ink onto the substrate. The carriage 18 moves along the rail system 16, depositing ink on the substrate as it traverses the rail system 16. Upon the completion of a traversal, the substrate steps ahead by movement of the transport belt 14 to position the substrate for a return traversal and subsequent ink deposit. In some instances, the carriage passes over the same area multiple times, laying down swaths of image pixels each time, building an image consecutively.

The carriage 18 holds a group of print heads configured to individually jet out colors onto the substrate during a multi-pass printing application. According to the prior art, print heads jetting glossy ink create images that oftentimes suffer from the gloss banding effect.

In the presently preferred embodiments of the invention, one or more extra set of print heads are added to the print carriage as well as one or more curing lamp. The one or more extra print heads provide the ability to print a clear UV formulation on top of the colored print in order to reduce or eliminate the gloss banding effect while the curing lamp cures the deposited ink with electromagnetic radiation.

Figure 2A:
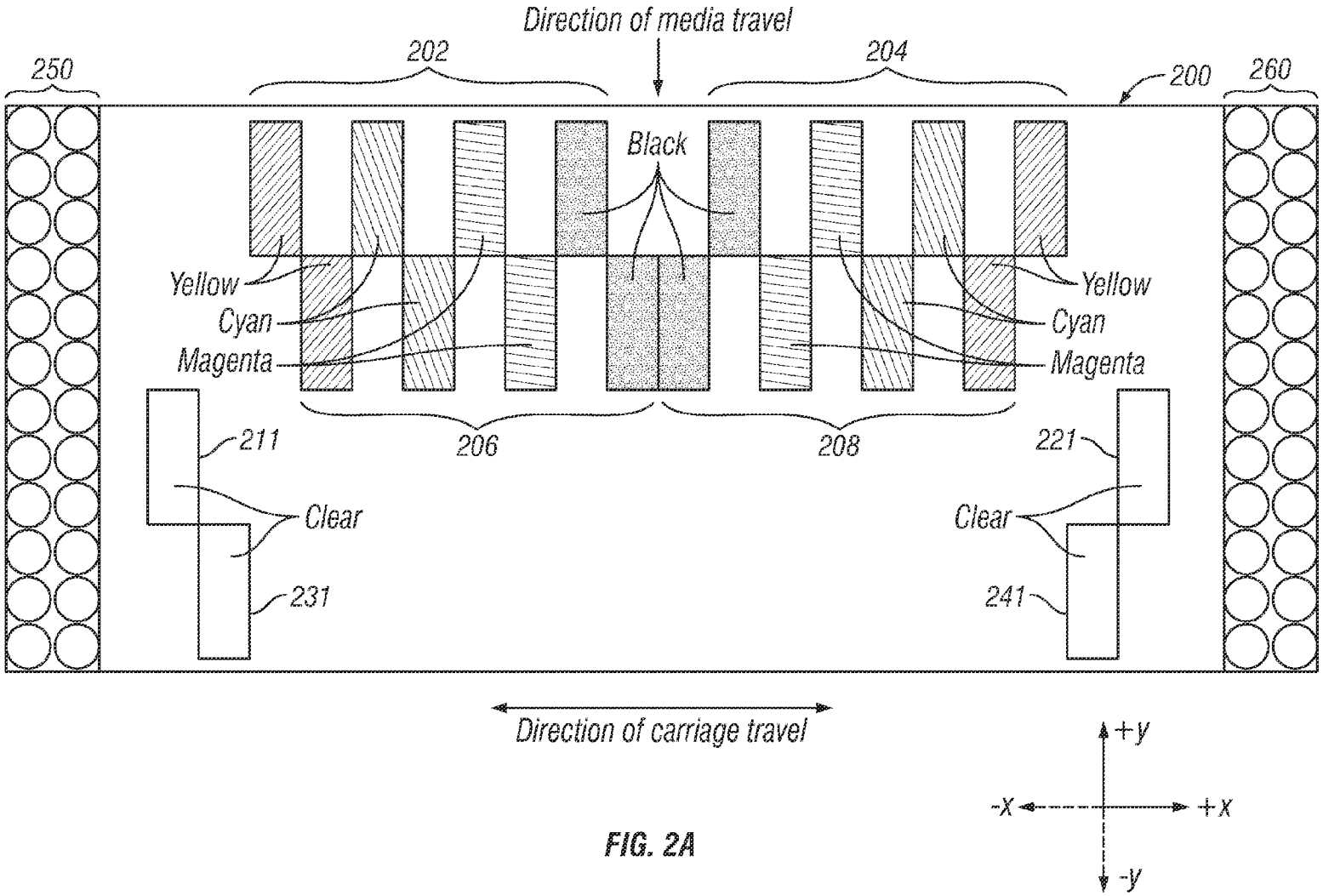
FIG. 2A illustrates a top down view of an inkjet printer carriage containing ink heads having layout pattern according to some embodiments of the invention.

FIG. 2A illustrates a top down view of an inkjet printer carriage containing ink heads having layout pattern according to some embodiments of the invention.

According to FIG. 2A, the inkjet printer carriage 200 traverses a printer base (not shown) via a rail (not shown) in the left-to-right and right-to-left directions, as indicated by the arrow labeled "Direction of carriage travel". Likewise, the media (not shown) being printed upon is moved in a –y direction beneath the carriage, as indicated by the arrow labeled "Direction of media travel". As the media moves beneath the print heads, the print heads deposit ink as the carriage traverses back and forth. Preferably, the print heads deposit UV-curable ink.

The inkjet printer carriage 200 is also configured with one or more curing lamps 250, 260. The curing lamp 250 exposes the deposited ink with electromagnetic radiation as the carriage 200 traverses the media from right to left. Likewise, the curing lamp 260 exposes the deposited ink with electromagnetic radiation as the carriage 200 traverses the media from left to right.

In the presently preferred embodiments of the invention, the curing lamps 250, 260 are configured to emit light in the ultraviolet (UV) range. However, those with ordinary skill in the art having the benefit of this disclosure will readily appreciate that a number of other visible and invisible colors and level of brightness are equally applicable to achieve the invention, as disclosed broadly herein.

In some embodiments of the invention, the one or more curing lamps 250, 260 comprise one or more light emitting diodes (LEDs). However, those with ordinary skill in the art having the benefit of this disclosure will readily appreciate that additional types of light sources are equally applicable to achieve the invention, as disclosed broadly herein.

In some embodiments of the invention, an additional curing lamp (not shown) is placed downstream, in the direction of media transport, from the printer heads for further curing the ink. Preferably, the curing lamp is at least the full width of the carriage.

In some embodiments of the invention, the print heads are grouped in the carriage 200 in various configurations. For example, the print heads of FIG. 2A are configured in six groups. First, four groups 202, 204, 206, and 208 of colored ink print heads are placed on the portion of the print carriage 200 that first passes over the media. Accordingly, the media first encounters the colored ink print heads during its transport through the printing system.

Preferably, the groups 202, 204, 206, and 208 of colored print heads are arranged in color clusters defining a standard color model. For example, as shown in FIG. 2A, the groups 202, 204, 206, and 208 contain colors defining the CMYK color model. Those of ordinary skill in the art will readily appreciate that other color models, other arrangements, and other colored inks will equally benefit from the invention.

In the presently preferred embodiments of the invention, the carriage 200 contains at least one additional print head for depositing a clear overcoat of ink. For example, the print carriage 200 of FIG. 2A contains four curable, clear ink print heads 211, 221, 231, 241. These clear ink print heads 211, 221, 231, 241 are situated on a back portion of the print carriage 200, such that the media encounters the clear ink print heads 211, 221, 231, 241 after being printed in with the colored ink print heads. Accordingly, the clear ink is printed on top of the colored ink. In the presently preferred embodiments of the invention, the clear ink is UV-curable.

In some embodiments of the invention, this layout pattern is achieved by increasing the width (on the y-axis) of a standard printer carriage, such that the final print pass is that of the clear ink only.

The colored inks are put down in a number of passes by the first row or rows of heads. In some embodiments, groups 202 and 204 deposit ink onto a first portion of the media while groups 206 and 208 deposit ink onto a second portion. In some other embodiments, groups 202 and 204 deposit ink on a first portion of media during a first traversal of the carriage 200 while groups 206 and 208 deposit an overcoat onto the same portion during a return traversal of the carriage 200, and so on.

The deposited inks are cured on each successive print pass by the two UV lamps 250, 260 at the end of the carriage 200. As the substrate is moved relative the carriage 200, the clear ink formulation is deposited onto the already cured colors and then subsequently cured itself.

Figure 2B:
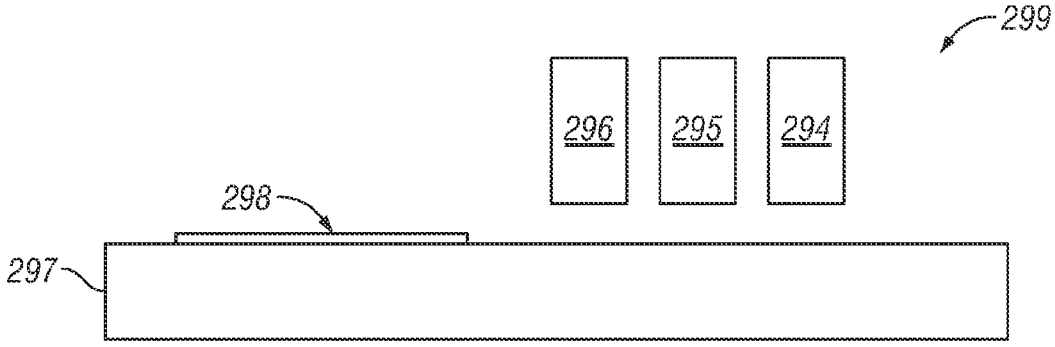
FIG. 2B illustrates an in-line inkjet printing apparatus configured to deposit a colored ink layer and a clear ink top layer that are cured with a UV light source according to some embodiments of the invention.

FIG. 2B illustrates an in-line inkjet printing apparatus 299 configured to deposit a colored ink layer and a clear ink top layer that are cured with a UV light source according to some embodiments of the invention.

According to FIG. 2B, substrate 298 traverses a platen 297, as indicated by an arrow, and directed through a series of print applicators. The substrate 298 is first exposed to a set of colored print heads 296 for applying colored ink to the substrate. In the presently preferred embodiments of the invention, the colored print heads 296 contain ink defining the CMYK color model. However, it will be readily apparent to those with ordinary skill in the art having the benefit of the disclosure that other color models, now known or later developed, are equally applicable to accomplish the invention, as disclosed broadly herein.

Next, the substrate 298 is transported beneath a set of clear ink print heads 295 for applying a clear ink top-layer to the substrate 298. Some embodiments of the invention involve applying the clear ink layer in preprogrammed pattern. Other embodiments of the invention involve gathering clear ink layer pattern information from the source file itself and applying the clear ink layer as specified. Other embodiments of the invention involve accepting user specifications for the application of the clear ink layer and applying the clear ink layer as specified by the user.

Finally, the substrate 298 transported to a curing region of the inkjet printing apparatus 299. The curing region includes at least one curing lamp 294 for exposing the substrate 298 with electromagnetic illumination, thereby curing the deposited ink. In the presently-preferred embodiments of the invention, the ink is a ultraviolet (UV) curable ink and the curing lamp comprises light-emitting diodes (LEDs) in the ultraviolet range. However, it will be readily apparent to those with ordinary skill in the art having the benefit of the disclosure that other types of lighting technology are equally applicable.

Some other embodiments of the invention involve an in-line inkjet printing apparatus configured to deposit colored ink layers and a clear ink top layer that are individually cured with multiple UV light sources.

Figure 2C:
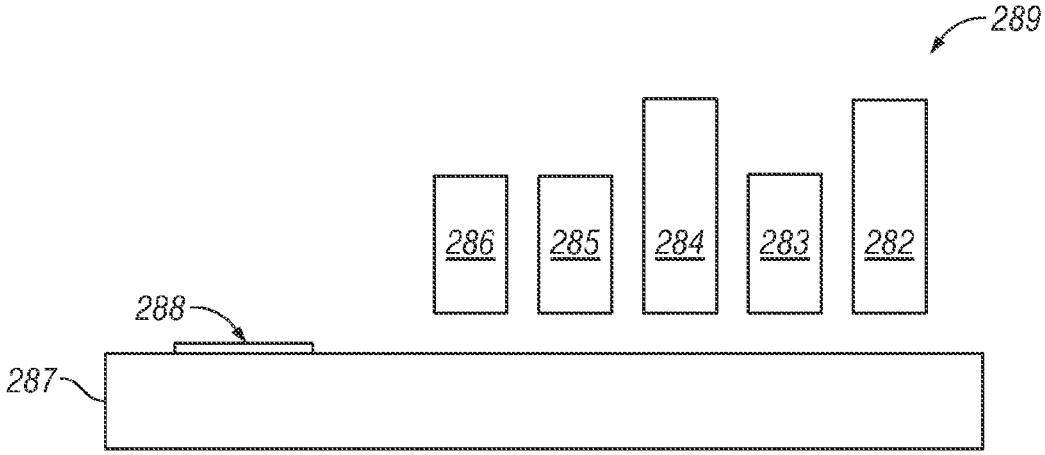
FIG. 2C illustrates an in-line inkjet printing apparatus configured to deposit a colored ink layer and a clear ink top layer that are individually cured with multiple UV light sources according to some embodiments of the invention.

FIG. 2C illustrates an in-line inkjet printing apparatus 289 configured to deposit colored ink layers and a clear ink top layer that are individually cured with multiple UV light sources according to some embodiments of the invention.

According to FIG. 2C, substrate 288 traverses a platen 287, as indicated by an arrow, and directed through a series of print applicators. The substrate 288 is exposed to a first set of colored print heads 286 and at least one additional set of colored print heads 285 for applying colored ink to the substrate. The colored ink is then transported beneath a curing lamp 284 for hardening the deposited colored ink.

Next, the substrate 288 with cured, colored ink is transported beneath one or more clear print heads 283 configured for depositing a pattern of a clear top coat ink layer. The patterned clear top coat ink is then transported beneath an additional curing lamp 282 for hardening the top coat layer of ink.

Figure 3:
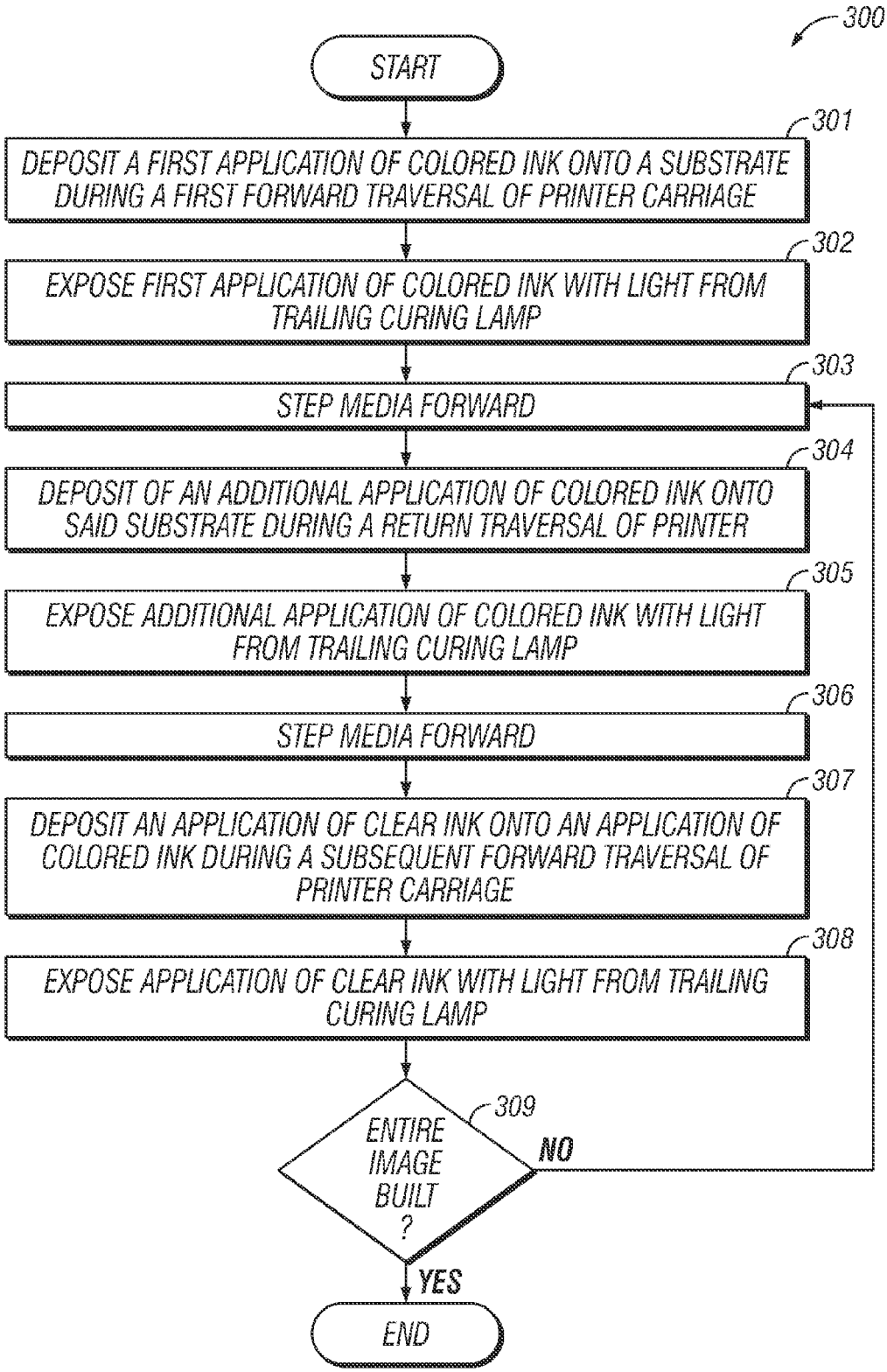
FIG. 3 illustrates a method of depositing colored ink, curing the colored ink, depositing a clear top coat, and curing the top coat according to some embodiments of the invention.

FIG. 3 illustrates a method 300 of depositing colored ink, curing the colored ink, depositing a clear top coat, and curing the top coat according to some embodiments of the invention.

The method 300 begins with ink heads depositing a first application of colored ink onto a substrate during a first forward traversal of printer carriage 301. Next, the first application of colored ink is exposed to light from trailing curing lamp 302. The media steps forward 303 and an additional application of colored ink is deposited onto said substrate during a return traversal of printer carriage 304. The additional deposition application of colored ink is exposed with light from trailing curing lamp 305. The media steps forward 306 and an application of clear ink is deposited onto the applications of colored ink during a subsequent forward traversal of printer carriage 307. The clear application of ink is cured with light from trailing curing lamp 308. If the image is not entirely built 309, then the method 300 continues with stepping the media forward 303 and depositing an additional application of colored ink 304; however, if the entire image is built 309, then the method ends.

In the presently preferred embodiments of the invention, the clear ink is printed in a random pattern. The random pattern is created by a Raster Image Processor (RIP), which is used in the printing process to convert an image file (BITMAP, etc) into a series of droplets and target locations.

The Raster Image Processor (RIP) is configured in firmware, hardware, or software versions. A firmware RIP is built-in to the device, such as the PostScript RIP built-in to many desktop printers. A hardware RIP is a dedicated piece of hardware configured to process digital files. A hardware RIP often comes with specific types of devices, such as an imagesetter. A software RIP is an independent program that can work with many types of devices.

In some embodiments of the invention, the clear ink patterning is processed with a RIP having a topcoat patterning module incorporated therein. Some other embodiments involve a standalone topcoat processing module operatively coupled with a RIP. Some other embodiments involve a topcoat processing applet available for incorporating into software. In some embodiments, topcoat processing software is available as a network-based topcoat processing servlet. Those having ordinary skill in the art will appreciate that other means of delivery, now known or later developed, are equally applicable for providing the topcoat processing functions as described herein.

Some embodiments of the invention involve configuring a RIP to output a raster with a certain percentage of clear ink droplet placement. The RIP is also used to add some noise and randomness into the drop placement, and to improve the visual print quality by ensuring unwanted patterns do not arise and distort the quality.

According to some embodiments of the invention, the RIP is configured as to a given percentage of clear ink to print over colored ink by information contained within the source image file itself (explained in more detail below). In some other embodiments, the RIP may be automatically set to print a given value.

Figure 4:
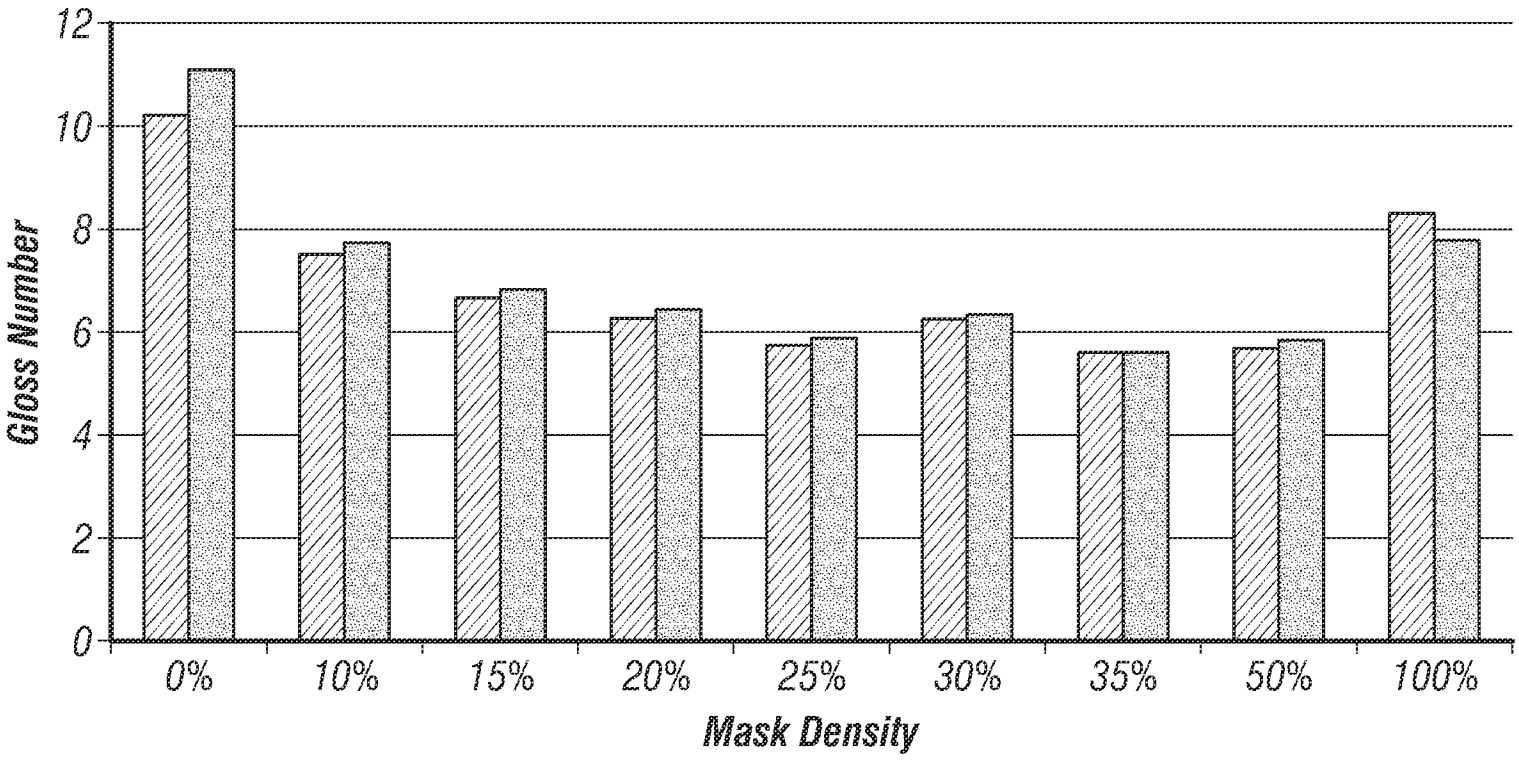
FIG. 4 illustrates a graph of gloss as a function of clear coat density for a two-coat gloss data with varying mask densities.

The inventors have found that the range of 20% to 60% clear ink coverage positively reduces gloss banding. The inventors also found that gloss banding is minimized to the greatest extent when clear ink coverage ranges between 30% and 50%. FIG. 4 illustrates a graph of gloss number, the reflectiveness of the ink, as a function of clear coat density for a two-coat gloss data with varying mask densities. According to FIG. 4, each mask density is tested from two viewing angles, wherein two viewing angles are represented by a discrete bar plotted at each mark density.

Experiments show that a gloss differential, pass to pass, of more than 0.3 gloss units was very visible. At a level of 0.1 gloss units and below the gloss banding becomes hard to see with the eye. The patterned UV clear layer provides gloss differential values of 0.1 or lower, consistently at a variety of print speeds and modes. Typical prints prior to this improvement gave a gloss differential value of above 0.5.

As explained above, in the presently preferred embodiments of the invention, the clear ink is printed in a random pattern and it is this randomness of drop placement that ensures that there are no patterns visible.

Some embodiments of the invention involve precisely programming the RIP to adjust the application of a clear top coat layer of ink. For example, the RIP can be programmed to provide certain levels of UV clear coverage, depending upon the amount of color and number of colors (CYMK) being applied. This can be used to fine tune and automate the process to provide the lowest gloss banding for any image. In other examples, the RIP can use data from the file to create specific areas of low and high gloss. This patterning can be used to provide customers with visual effects that cannot be printed with prior RIP processors due to inherent gloss banding pitfalls.

As explained above, in some embodiments of the invention, the RIP is configured to process clear coat data while taking into account the source image itself. For example, in some embodiments of the invention, the RIP is configured to modulate clear ink coverage by image data color density. In some embodiments the RIP is configured to place more clear ink in higher percentages in areas of high color density or ink areas rich in one or more particular color.

In some embodiments of the invention, the RIP is configured to ensure that the clear ink is only printed in areas where there has been a color printed beneath it. This is to ensure that the clear does not impact the visual look of the substrate. It is optional to allow the clear to print on the substrate if required for some purpose.

Some embodiments of the invention involve controlling the size and placement of the clear ink mounds that are deposited onto the colored ink. The size of the mounds, or bumps, of clear ink impact the way in which light scatters, diffuse reflection, and impacts the creation of less glossy finish. For example, a Gloss No. of less than 10 is good, and a Gloss No. of less than 6 is preferred.

The inventors have found that when UV-curable clear ink is printed onto an application of color ink, previous applied and cured, the spread of the clear ink droplet varies with a number of factors including: the surface quality of the ink onto which it is printed; the chemical formulation of the UV-curable clear ink; and the time between when the clear ink is deposited and the time in which the clear ink is exposed to a curing lamp, i.e. "time to lamp".

In the preferred embodiments of the invention, the clear print heads and the curing lamps are positioned such that that the clear ink has a very short time to lamp. The ink droplet will spread after printing, but it is the time to lamp which dictates the amount of time the ink has to spread. Additionally, in some embodiments, the inks and UV clear are formulated such that the droplet does not spread rapidly. Preferably, the surfactants are chosen and the levels in the colors and clears are adjusted to control spread. Therefore, preferred embodiments of the invention involve controlling the levels of surfactants in such as way that the clear does not spread too much, such that the droplet can form a distinct bump on the colored ink.

Some embodiments of the invention involve controlling the clear ink droplet size by controlling the time between when the clear ink is deposited and the time in which the clear ink is exposed to a curing lamp, i.e. "time to lamp".

As explained above, a uniform low gloss top surface covers up any gloss banding patterns in the print, which were the cause of gloss banding, creating a very uniform, low gloss print.

In some embodiments of the invention, the clear ink print heads can be located immediately after the color print heads in the print process, or spaced some distance away from the color print heads so that the clear layer is laid down on a different step boundary.

The clear coating solution of the present invention allows a wider color gamut than normal printing without a resulting print that suffers from negative gloss banding effects. A higher color gamut is achieved by allowing the colored inks to spread to a greater extent than usual. In normal circumstances, this would create a glossy print, with various portions of the print having a very high gloss differential, and hence would look very poor due to gloss banding. However, the clear coating process of the invention allows the colored layer to spread and for white space to be minimized, without the use of excess ink. This fact benefits both color gamut and print quality by reducing graininess.

Therefore, some embodiments of the invention involve configuring the RIP to allow for a wider color gamut and more ink spread to be offset by the positive effects of clear coating. Although there will be a marginal loss of brightness due to the matte surface and diffuse reflection, this loss is more than compensated for by the increased drop spread of the colors. The formulation of the colored inks allows for the spread and the choice of surfactants and flow enhancers is key to allow this spread, not only when ink is printed onto substrate, but more importantly when ink is printed onto cured ink.

In some other embodiments, users choose the level of coverage from 0 to 100%. Although gloss banding is most reduced in the 30 to 50% range, where the gloss is lowest, the coverage level can be tuned to produce a much glossier print. Gloss banding will still see some improvement from the randomization of the drop placement. Where the customer application is such that the gloss banding is not an issue, such as distance viewing or with very "busy" images lacking large color fields, the customer can choose to not use the UV clear at all by turning coverage to 0%. Where the customer has a requirement for gloss, this can be maximized.

Although the presently preferred embodiments of the invention have described the clear top coating technique as a solution for masking the negative effects of gloss banding, it will readily apparent to those with ordinary skill in the art that the same techniques can be applied to other negative artifacts.

In some embodiments of the invention, the RIP is configured to automatically detect the presence of moiré using Fast Fourier Transform techniques and configured to apply a topcoat thereon to mask the effect.

While automatic configuration of the topcoat is oftentimes preferred, manual configuration is sometimes desired. Accordingly, some embodiments of the invention involve end user controls for controlling the application of a clear top coat layer of ink. For example, in some embodiments of the invention, an applet is configured for providing a host image creation application with the ability to specify clear coat patterns and densities. In a more specific example, an image finishing applet for allowing a user to control clear coat patterns and densities is configured to be incorporated via an API into a graphics editing program, a word processing program, etc.

Figure 5:
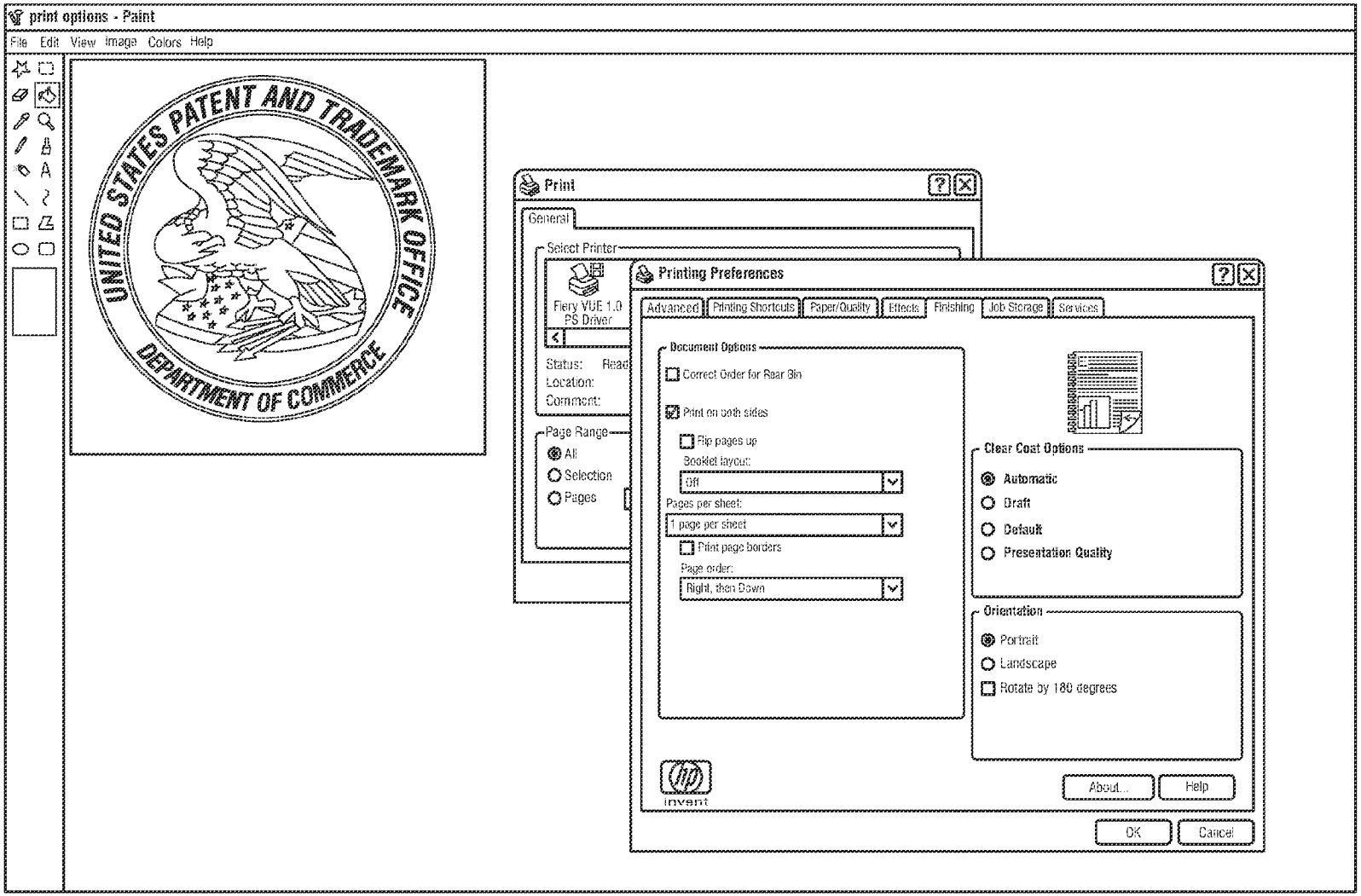
FIG. 5 illustrates and example of graphics editing program according to some embodiments of the invention.

FIG. 5 illustrates and example of graphics editing program 500 with a clear coat applet loaded therein configured for providing a user with a interface for specifying clear coat print options. As shown in FIG. 5, the "Finishing" tab 510 of the "Printing Preferences" options menu 520 contains a "Clear Coat Options" area 550 for specifying clear coat options.

Figure 6:
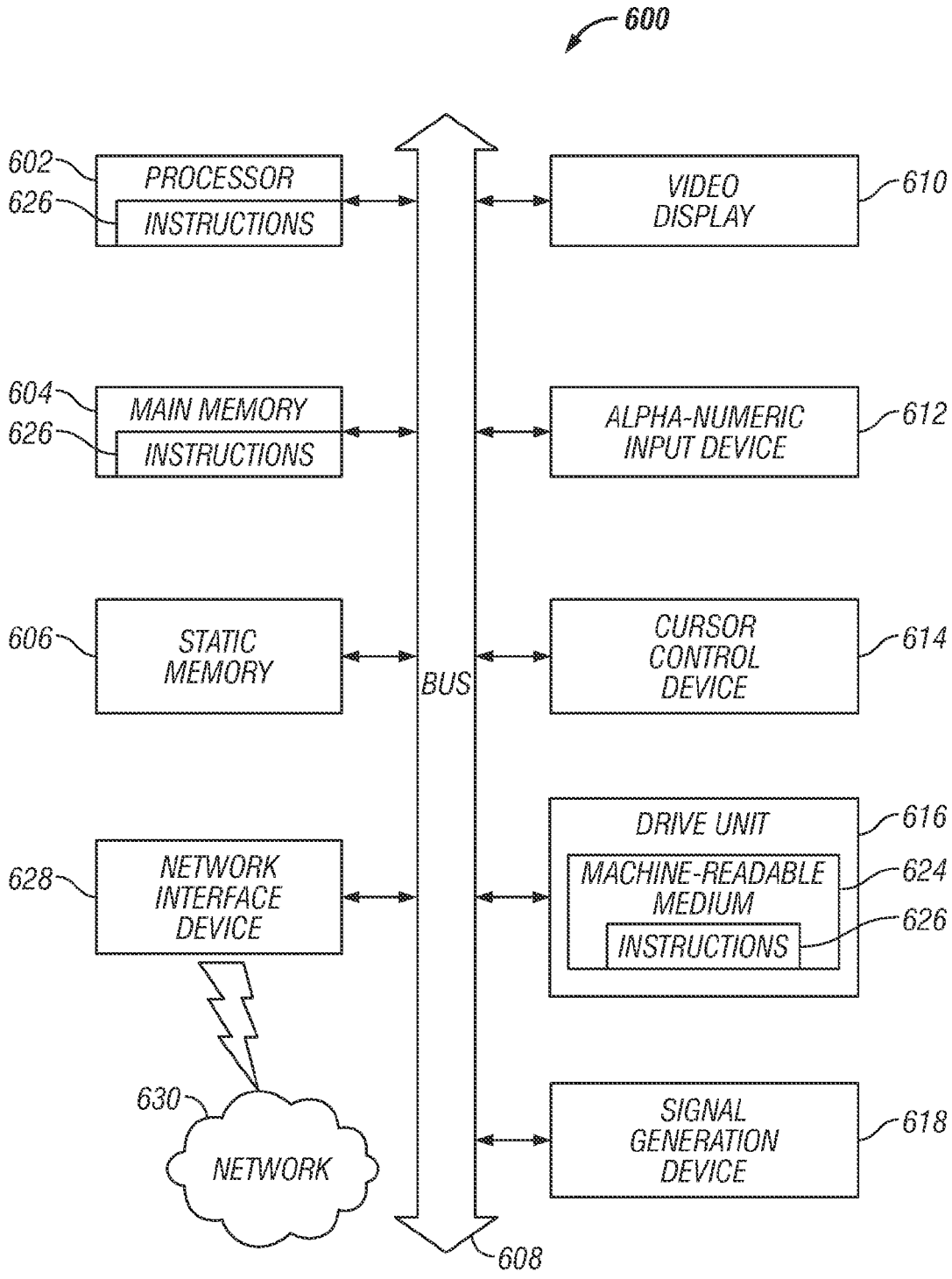
FIG. 6 is a block schematic diagram of a machine in the exemplary form of a computer system within which a set of instructions may be programmed to cause the machine to execute the logic steps of the invention according to some embodiments of the invention.

FIG. 6 is a block schematic diagram of a machine in the exemplary form of a computer system within which a set of instructions may be programmed to cause the machine to execute the logic steps of the invention.

FIG. 6 is a block schematic diagram of a machine in the exemplary form of a computer system 600 within which a set of instructions may be programmed to cause the machine to execute the logic steps of the invention. In alternative embodiments, the machine may comprise a network router, a network switch, a network bridge, personal digital assistant (PDA), a cellular telephone, a Web appliance or any machine capable of executing a sequence of instructions that specify actions to be taken by that machine.

The computer system 600 includes a processor 602, a main memory 604 and a static memory 606, which communicate with each other via a bus 608. The computer system 600 may further include a display unit 610, for example, a liquid crystal display (LCD) or a cathode ray tube (CRT). The computer system 600 also includes an alphanumeric input device 612, for example, a keyboard; a cursor control device 614, for example, a mouse; a disk drive unit 616, a signal generation device 618, for example, a speaker, and a network interface device 620.

The disk drive unit 616 includes a machine-readable medium 624 on which is stored a set of executable instructions, i.e. software, 626 embodying any one, or all, of the methodologies described herein below. The software 626 is also shown to reside, completely or at least partially, within the main memory 604 and/or within the processor 602. The software 626 may further be transmitted or received over a network 628, 630 by means of a network interface device 620.

In contrast to the system 600 discussed above, a different embodiment uses logic circuitry instead of computer-executed instructions to implement processing entities. Depending upon the particular requirements of the application in the areas of speed, expense, tooling costs, and the like, this logic may be implemented by constructing an application-specific integrated circuit (ASIC) having thousands of tiny integrated transistors. Such an ASIC may be implemented with CMOS (complimentary metal oxide semiconductor), TTL (transistor-transistor logic), VLSI (very large systems integration), or another suitable construction. Other alternatives include a digital signal processing chip (DSP), discrete circuitry (such as resistors, capacitors, diodes, inductors, and transistors), field programmable gate array (FPGA), programmable logic array (PLA), programmable logic device (PLD), and the like.

It is to be understood that embodiments may be used as or to support software programs or software modules executed upon some form of processing core (such as the CPU of a computer) or otherwise implemented or realized upon or within a machine or computer readable medium. A machine-readable medium includes any mechanism for storing or transmitting information in a form readable by a machine, e.g. a computer. For example, a machine readable medium includes read-only memory (ROM); random access memory (RAM); magnetic disk storage media; optical storage media; flash memory devices; electrical, optical, acoustical or other form of propagated signals, for example, carrier waves, infrared signals, digital signals, etc.; or any other type of media suitable for storing or transmitting information.

Although the invention described herein with reference to the preferred embodiments, one skilled in the art will readily appreciate that other applications may be substituted for those set forth herein without departing from the spirit and scope of the invention.

For example, the printer may be a flat bed printer, in which the substrate is held stationary while the carriage and rail system move the print heads over the substrate to deposit ink thereon and thus form an image.

Accordingly, the invention should only be limited by the Claims included below.

The invention claimed is:

1. An inkjet printing system comprising:

a printer base;

a carriage configured for holding a plurality of inkjet print heads for depositing an application of ink onto a substrate, wherein said carriage comprises:

at least one group of color print heads containing UV-curable ink defining a color model, wherein said at least one group of color print heads are positioned on a first portion of said carriage;

at least one group of clear print heads containing a UV-curable, substantially clear ink, and at least one first UV light source;

a printer controller; and a processor operatively coupled with said carriage, said processor configured for:

receiving an image file in a description language describing a page to be printed;

translating said image file into an internal description language representation of said image contained in said image file;

rendering said internal description into an ink pattern map capable of being built by a plurality of print heads;

applying an additional description of a clear layer pattern to be printed on top of said ink pattern map; and exporting said ink pattern map and additional description of a clear layer pattern to a printer controller to initiate a print job.

2. The inkjet printing system of claim 1, said printer base comprising a transport for advancing a substrate through a printing region; and further comprising:

a rail system coupled to said printer base;

the carriage coupled to said rail system;

wherein said rail system is disposed substantially normal to the motion of said substrate; and wherein said carriage is configured to traverse back-and-forth on said rail system.

3. The inkjet printing system of claim 2, said printer comprising a flat bed printer, in which the substrate is held stationary while said carriage and rail system move the plurality of print heads over the substrate to deposit ink thereon and thus form an image.

4. The inkjet printing system of either of claims 1, 2, and 3, said carriage further comprising:

at least one additional group of color print heads, wherein said at least one additional group of color print heads are positioned in an intermediate portion of said carriage, wherein said at least one additional group of color print heads is positioned above said substrate before said at least one group of clear print heads, but after said at least one group of color print heads.

5. The inkjet printing system of claim 1, said carriage further comprising:

at least one additional UV light source, wherein said first UV light source is positioned on a first edge of said carriage that leads a forward traversal of said rail system and trails a return traversal of said rail system, and wherein said at least one additional UV light source is positioned on a second edge of said carriage that trails the forward traversal of said rail system and leads the return traversal of said rail system.

6. The inkjet printing system of claim 5, wherein said first UV light source and said at least one additional UV light source comprise LED lights.

7. The inkjet printing system of claim 5, wherein said first UV light source and said at least one additional UV light source each comprise a plurality of LED lights.

8. The inkjet printing system of claim 5, further comprising a lamp controller configured for selectively activating said first UV light source and at least one additional UV light source depending on whether said first UV light source and at least one additional UV light source is leading said traversal or trailing said traversal.

9. The inkjet printing system of claim 1, wherein said processor is configured for creating a RIP file from said image file.

10. The inkjet printing system of claim 1, wherein said processor is configured for determining a pattern for the application of said clear ink from data in said image file.

11. The inkjet printing system of claim 1, wherein said processor is configured for automatically detecting a moiré pattern in said image file.

12. The inkjet printing system of claim 1, wherein said processor is configured for reading user-specified instructions for the application of said clear ink.

13. The inkjet printing system of claim 1, wherein said processor is configured for gathering clear layer printing preferences from a user of a host application via an API.

14. A processor configured for performing the steps of:

receiving an image file in a description language describing a page to be printed;

translating said image file into an internal description language representation of said image contained in said image file;

rendering said internal description into an ink pattern map capable of being built by a plurality of print heads;

applying an additional description of a clear layer pattern to be printed on top of said ink pattern map; and exporting said ink pattern map and additional description of a clear layer pattern to a printer controller to initiate a print job.

15. The processor of claim 14, further configured for:

determining if said image file contains clear layer instructions, and, if so, extracting said clear layer instructions.

16. The processor of claim 15 further configured for:

using said clear layer instructions when applying said additional description of a clear layer pattern if said image file contains clear layer instructions; and using default clear layer pattern instructions when applying said additional description of a clear layer pattern if said image file does not contain clear layer instructions.

17. The processor of claim 14, further configured for:

gathering explicit clear layer instructions from a user via a software program API; and using said explicit clear layer pattern instructions when applying said additional description of a clear layer pattern.

18. A computer-implemented method comprising the steps of:

receiving, by a processor, an image file in a description language describing a page to be printed;

translating, by a processor, said image file into an internal description language representation of said image contained in said image file;

rendering, by a processor, said internal description into an ink pattern map capable of being built by a plurality of print heads;

applying an additional description of a clear layer pattern to be printed on top of said ink pattern map; and exporting said ink pattern map and additional description of a clear layer pattern to a printer controller to initiate a print job.

19. The method of claim 18, further comprising:

determining if said image file contains clear layer instructions, and, if so, extracting said clear layer instructions.

20. The method of claim 19 further comprising:

using said clear layer instructions when applying said additional description of a clear layer pattern if said image file contains clear layer instructions; and using default clear layer pattern instructions when applying said additional description of a clear layer pattern if said image file does not contain clear layer instructions.

21. The method of claim 18, further comprising:

gathering explicit clear layer instructions from a user via a software program API; and using said explicit clear layer pattern instructions when applying said additional description of a clear layer pattern.

22. A non-transitory computer-readable storage medium storing instructions, which when executed by a processor, cause the processor to perform:

receiving an image file in a description language describing a page to be printed;

translating said image file into an internal description language representation of said image contained in said image file;

rendering said internal description into an ink pattern map capable of being built by a plurality of print heads;

applying an additional description of a clear layer pattern to be printed on top of said ink pattern map; and exporting said ink pattern map and additional description of a clear layer pattern to a printer controller to initiate a print job.

* * * * *